US010047545B2

(12) United States Patent
Ford

(10) Patent No.: US 10,047,545 B2
(45) Date of Patent: Aug. 14, 2018

(54) DOOR SECURITY AND CLOSING DEVICE

(71) Applicant: Glenn Ford, Clairton, PA (US)

(72) Inventor: Glenn Ford, Clairton, PA (US)

( * ) Notice: Subject to any disclaimer, the term of this patent is extended or adjusted under 35 U.S.C. 154(b) by 0 days.

(21) Appl. No.: 14/833,726

(22) Filed: Aug. 24, 2015

(65) Prior Publication Data

US 2016/0060923 A1 Mar. 3, 2016

Related U.S. Application Data

(60) Provisional application No. 62/042,965, filed on Aug. 28, 2014.

(51) Int. Cl.
*E05C 17/00* (2006.01)
*E05B 63/00* (2006.01)
(Continued)

(52) U.S. Cl.
CPC ..... *E05B 63/0052* (2013.01); *E05B 47/02* (2013.01); *E05B 63/0004* (2013.01); *E05C 17/56* (2013.01); *E05F 15/70* (2015.01)

(58) Field of Classification Search
CPC ..... E05C 17/54; E05C 17/56; E05C 19/006; E05C 17/44; E05F 15/611; E05F 15/614; E05F 15/616; E05F 15/70; E05F 15/73; E05F 15/75; E05F 1/002; E05F 1/006; E05F 3/226; E05F 15/40; E05F 15/48; E05F 15/60; E05F 15/72; E05B 17/0025; E05B 17/0029; E05B 47/0001; E05B 47/0046; E05B 2047/002; E05B 2047/0067; E05B 63/0052; E05B 63/22; E05B 63/0004; E05B 47/02; Y10S 292/15; Y10S 292/65; Y10T 292/03; Y10T 292/1079; Y10T 292/307; Y10T 292/308; Y10T 292/65; Y10T 292/67; Y10T 292/71; Y10T 292/73; Y10T 16/61; Y10T 70/5164;
(Continued)

(56) References Cited

U.S. PATENT DOCUMENTS 3,444,546 A * 5/1969 Hawkins ..... E05B 45/086 200/61.67
3,781,943 A 1/1974 Cain
(Continued)

FOREIGN PATENT DOCUMENTS

EP 1176276 A1 * 1/2002 ..... E05B 17/0029
WO WO 0073609 A1 * 12/2000 ..... E05C 17/166

*Primary Examiner* — Christine M Mills
(74) *Attorney, Agent, or Firm* — Daniel Baudwin; Global Intellectual Property Agency, LLC

(57) ABSTRACT

A door security and closing device is provided that is mountable to the frame of a doorway. The device comprises a movable arm that is positioned within the swing path of a door to resist and close the door shut in response to pressure applied to the door, or input from the user. The movable arm has a retracted position, an extended position, and a stowed state. In the retracted position, the arm is in the swing path of the door and allows partial opening of the door. If pressure is applied to the arm once the door is opened, a force transducer registers the force applied and the arm is directed to close the door in response. The system is controlled by a processor, a motor controller, and an electric motor. Switches are provided to register the position of the arm, while user buttons allow operable movement thereof.

12 Claims, 7 Drawing Sheets

(51) Int. Cl.
*E05F 15/70* (2015.01)
*E05B 47/02* (2006.01)
*E05C 17/56* (2006.01)

(58) Field of Classification Search
CPC ..... Y10T 70/7102; Y10T 70/7107; Y10T 70/7113; Y10T 70/7119; Y10T 70/7124
USPC ... 292/1, 199, 279, 280, 338, 339, 342, 343, 292/DIG. 15, DIG. 65; 70/93, 278.7, 70/279.1, 280–282; 49/339, 340, 341, 49/342, 343, 139, 350
See application file for complete search history.

(56) References Cited

U.S. PATENT DOCUMENTS

| | | | | | |
|---|---|---|---|---|---|
| 3,854,310 | A * | 12/1974 | Paull | E05B 47/0012 | 292/201 |
| 4,284,980 | A * | 8/1981 | Hoinski | G08B 13/08 | 116/86 |
| 4,609,215 | A | 9/1986 | Self | | |
| 5,177,988 | A | 1/1993 | Bushnell | | |
| 5,727,348 | A * | 3/1998 | Arnell | G06T 5/20 | 49/25 |
| 5,738,389 | A * | 4/1998 | Marks | E05C 17/166 | 292/63 |
| 6,106,032 | A | 8/2000 | Och | | |
| 6,750,568 | B2 * | 6/2004 | Ohara | E05B 47/0012 | 307/141.4 |
| 7,350,836 | B2 * | 4/2008 | Simpson | E05C 17/48 | 16/82 |
| 2005/0091928 | A1 * | 5/2005 | Okulov | E05F 15/41 | 49/341 |
| 2008/0264119 | A1 * | 10/2008 | Thomas | E05B 63/0052 | 70/77 |

* cited by examiner

DOOR SECURITY AND CLOSING DEVICE

CROSS REFERENCE TO RELATED APPLICATION

This application claims the benefit of U.S. Provisional Application No. 62/042,965 filed on Aug. 28, 2014. The above identified patent application is herein incorporated by reference in its entirety to provide continuity of disclosure.

BACKGROUND OF THE INVENTION

Field of the Invention

The present invention relates to door security devices and home security latches. More specifically, the present invention relates to a device affixable to the door frame of a door that employs a movable arm that can prevent a door from being forced open, and furthermore one that can operably close the door shut when triggered.

Chain locks and other currently available door security devices leave individuals at risk. These locks can easily be overcome, either by brute force or by circumventing the lock. For chain locks particularly, these devices offer minimal protection after a deadbolt has been removed. However, chain locks and sliding locks are popular because they allow the door to be moved slightly ajar for interactions across the threshold of the door. However, once opened, the occupant has significantly reduced the security of the door, as chains and slide locks can easily be broken or snapped with brute force. Furthermore, the occupant must forcibly counteract an intruder if the intruder is holding the door ajar against the chain or slide lock.

The present invention provides an assembly that allows the user to maintain security while partially opening a door. The present invention furthermore offers a means to assist closing the door after the door has been partially opened and in response to pressure against the door from an outsider. The present invention comprises an assembly that is mounted along the frame of a door, whereby a movable arm is positioned within the swing path of the door to operably close the door, allow partial opening, or allow complete opening thereof. The device is motor-controlled and includes several sensors that are used to control the positioning of the movable arm. The motive input on the arm may vary, and may include a gear driven assembly, a hydraulic assembly, or a pneumatic assembly. Inputs from the user and force placed on the system control its operation while in use.

Overall, the present invention provides an active door closing and security device that advances the art. There is currently a need in the prior art for a secure door closing mechanism that can be selectively activated or that can act in response to force applied to the door to which the assembly in in a working state. The present invention improves security of a dwelling, while also offering the convenience of partial opening of the door when visual access across the door threshold is desired.

SUMMARY OF THE INVENTION

The following summary is intended solely for the benefit of the reader and is not intended to be limiting in any way. The present invention provides a new door security and door closing device, wherein the device can be utilized for providing operably closing a door and improving security for the user.

It is therefore an object of the present invention to provide a new and improved door security and closing device that has all of the advantages of the prior art and none of the disadvantages.

It is another object of the present invention to provide a door security and closing device that comprises a housing unit supporting a controller assembly and a movable arm. The housing unit is adapted to be secured to a door frame of a door, and the movable arm is operatively positioned within the swing path of a door to allow partial opening of the door, to close the door, or to secure the door in a closed and locked position.

Another object of the present invention is to provide a door security and closing device in which the movable arm has an extended position disposed within the swing path of a door and against an interior surface of the door when the door is closed.

Another object of the present invention is to provide a door security and closing device in which the movable arm has a retracted position within the swing path of the door and offset from the interior surface of the door when the door is closed.

Another object of the present invention is to provide a door security and closing device in which the movable arm having a stowed position whereby the movable arm is outside of the swing path of the door and the door can be opened and closed freely.

Another object of the present invention is to provide a door security and closing device in which the housing supporting an electric motor and a motor controller assembly. A power supply provides power to the housing.

Another object of the present invention is to provide a door security and closing device in which the motor controller assembly further comprises a processor, a motor driver, a force transducer, a retract switch, an extend switch, an extend limit switch, and a retract limit switch.

Another object of the present invention is to provide a door security and closing device in which the force transducer is adapted to measure the force applied to the movable arm when pressed upon by the door. The force transducer is used to register an outside user pressing against the slightly ajar door, whereby appropriate action can be taken to close the door using the movable arm.

Another object of the present invention is to provide a door security and closing device, in which the retract limit switch closes when the movable arm is in the retracted position, and the extend limit switch closes when the movable arm is in the extended position. The limit switches are used to determine when the movable arm is in its outermost working positions—that is, in a fully retracted or fully extended position.

Another object of the present invention is to provide a door security and closing device wherein the processor and motor driver direct the electric motor to move the movable arm into the extended position and to the point where the extend limit switch is closed when the extend switch is activated.

Another object of the present invention is to provide a door security and closing device wherein the processor and motor driver direct the electric motor to move the movable arm into the retracted position and to the point where the retract limit switch is closed when the retract switch is activated.

Another object of the present invention is to provide a door security and closing device wherein if the force transducer measures a predefined force on the movable arm when the arm is in the retracted position, the processor and motor driver direct the electric motor to move the movable arm into the extended position until the extend limit switch is closed. This function closes the door into a closed state using the force of the movable arm and its motive input, thereby closing the door in response to resistance by an intruder.

Another object of the present invention is to provide a door security and closing device wherein the motive input for the movable arm is a hydraulic system. A hydraulic cylinder is disposed between the electric motor and the movable arm, and the electric motor drives a fluid pump that forces hydraulic fluid into a first end or a second end of the hydraulic cylinder to move the movable arm from the working end of the hydraulic cylinder.

Another object of the present invention is to provide a door security and closing device, in which the hydraulic system further comprises a valve for operatively diverting the hydraulic fluid to the first end or second end of the hydraulic cylinder, depending on the desired movement of the movable arm. The movable arm is moved into the extended position when the electric motor drives the fluid pump and the valve is diverting hydraulic fluid into the second end of the hydraulic cylinder. The movable arm is moved into the retracted position when the electric motor drives the fluid pump and the valve is diverting hydraulic fluid into the first end of the hydraulic cylinder.

Another object of the present invention is to provide a door security and closing device wherein the motive input for the movable arm is a pneumatic system. A pneumatic cylinder is disposed between the electric motor and the movable arm. The electric motor drives a fluid pump that drives compressed air to a first end or a second end of the pneumatic cylinder to move the movable arm from the working end of the pneumatic cylinder.

Another object of the present invention is to provide a door security and closing device, in which the pneumatic system further comprises a valve for operatively diverting the compressed air to the first end or second end of the pneumatic cylinder, depending on the desired movement of the movable arm. The movable arm is moved into the extended position when the electric motor drives the fluid pump and the valve is diverting compressed air into the second end of the pneumatic cylinder. The movable arm is moved into the retracted position when the electric motor drives the fluid pump and the valve is diverting compressed air into the first end of the pneumatic cylinder.

Another object of the present invention is to provide a door security and closing device wherein the motive input for the movable arm is a gear assembly. The gear assembly is disposed between the electric motor and the movable arm, wherein the assembly comprises a worm gear driven by the electric motor, an intermediate gear on a gear shaft, a drive gear on the same gear shaft, and a movable arm gear connected to the movable arm. The movable arm is moved into the extended position when the electric motor drives the worm gear in a first rotational direction. The movable arm is moved into the retracted position when the electric motor drives the worm gear in a second rotational direction.

Another object of the present invention is to provide a door security and closing device, wherein the movable arm are supported along the door frame by a mounting member and a hinge. The hinge operatively allows the movable arm to be pivoted into a working position and the stowed position. When in the stowed position, the movable arm can move between the extended position and the retracted position within the swing path of the door.

Another object of the present invention is to provide a door security and closing device, wherein the hinge may further comprise a locking member to prevent pivoting of the hydraulic cylinder and movable arm about the hinge, and the locking member may further comprises a kickstand member.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
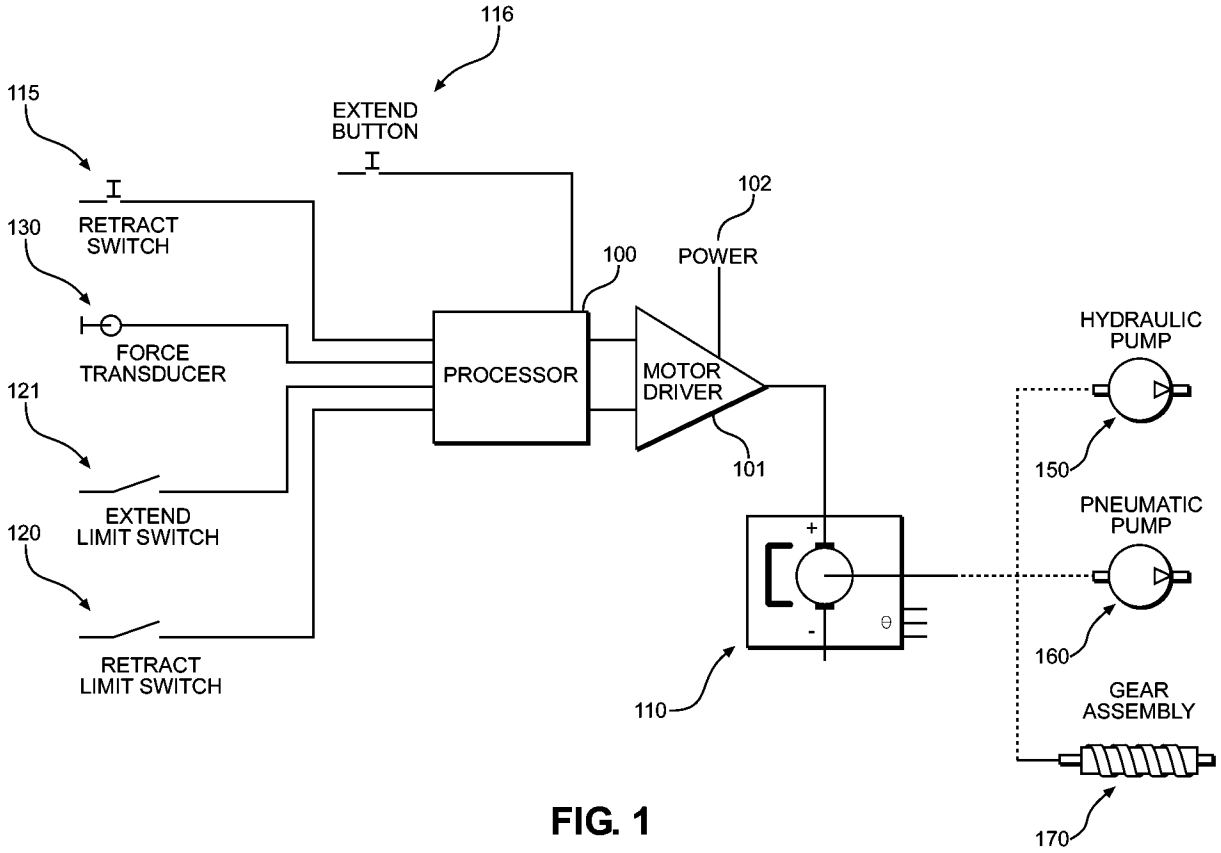
FIG. 1 shows a schematic view of the controller assembly of the present invention.

Reference is made herein to the attached drawings. Like reference numerals are used throughout the drawings to depict like or similar elements of the door security and closing device of the present invention. For the purposes of presenting a brief and clear description of the present invention, the preferred embodiment will be discussed as used for securing a door when the door is slightly ajar, and furthermore for closing the door when resistance is placed on the door while closing the same. The figures are intended for representative purposes only and should not be considered to be limiting in any respect.

Referring now to FIG. 1, there is shown a schematic view of the controller assembly of the present invention. The controller assembly controls the operation of the door security and closing device. External inputs are received from the user and from force applied to the door when the device is in use. The controller assembly is preferably secured within a housing unit that is mounted adjacent to a door or along the door frame. The controller assembly controls the operation of a movable arm that is operably disposed within the swing path of the door to prevent the door from freely opening, to allow partial opening thereof, and furthermore to assist closing the device in an emergency. The controller assembly can be modified to function with several different embodiments of the movable arm, and the motive input that actuates the movable arm may be updated while maintaining the same or substantially the same controller assembly. For instance, as shown in FIG. 1, the controller assembly may actuate a hydraulic pump 150, a pneumatic pump 160, or a gear assembly 170 for mechanically moving the movable arm.

The controller assembly comprises a processor 100, which preferably comprises a programmable microprocessor that can receive inputs and send signals to a motor driver 101. The motor driver 101 is preferably an integrated circuit that receives input from the processor 100 and directs an electric motor 110 to turn in accordance with the processor directions. The controller assembly receives power 102 from an external or optionally internal power supply 102. The electric motor 110 provides motive input for the pumps or gear assembly to move the movable arm into various positions based on inputs received from the user and from the door itself.

The processor 100 receives several inputs and uses those inputs to determine how to control the electric motor 110, and thus the position of the movable arm. First, an extend switch 116 and a retract switch 115 are provided. These switches allow the user to operably direct the controller assembly to move the movable arm into either an extend position or a retract position, respectively. When the extend switch 116 is closed (i.e. when the user presses an extend button associated with the extend switch), the processor 100 will activate the motor driver 101, which will activate the electric motor 110 to actuate the movable arm towards the door and until an extend limit switch 121 is engaged. The extend limit switch 121 is a switch that closes or opens when the movable arm has been moved to a predesignated extend position. The extent and exact position of the movable arm at the extend position can be set based on this switch 121. When the motor 110 has driven the movable arm into the predesignated extend position, the extend limit switch 121 is activated and the processor 100 receives input therefrom to deactivate the electric motor 110.

In a similar manner, when the retract switch 115 is activated ((i.e. when the user presses an retract button associated with the retract switch), the processor 100 will activate the motor driver 101, which will activate the electric motor 110 to actuate the movable arm away from the door and until a retract limit switch 120 is engaged. The retract limit switch 120 is similar or the same as the extend limit switch 121—a switch that closes or opens when the movable arm has been moved to a predesignated retract position. The extent and exact position of the movable arm at the retract position can be set based on this switch 120. When the motor 110 has driven the movable arm into the predesignated retract position, the retract limit switch 120 is activated and the processor 100 receives input therefrom to deactivate the electric motor 110. The retract limit switch 120 may be set such that the movable arm is still within the sweep path of the door, or it may be set to provide free clearance for the door. In the former case, the movable arm allows partial opening of the door, to the point where the door swings into the movable arm. There may optionally be provided a stow button and stow limit switch (not shown) that move the movable arm outside of the door swing path. In a preferred configuration, the extend limit switch 121 is activated when the movable arm is within the swing path of the door but offset from the door interior surface, while the retract limit switch 120 is activated when the movable arm is positioned outside of the swing path of the door.

When the movable arm is in the retracted position and the retract limit switch is activated 120, a force transducer 130 measures force input on the movable arm. Based on force measured on the movable arm by the force transducer 130, the processor 100 may direct the motor driver 101 to activate the electric motor 110 to close the door. When the movable arm is in the retracted position, the door can slightly open to allow conversation and viewing through the slightly ajar door. If sufficient force is placed on the door such that the system registers an intruder attempting to force the door open after the door has already been slightly opened, the processor 100 will activate the electric motor 110 to move the movable arm into the extended position until the extend limit switch 121 is activated. This forcibly closes the door. This is useful if someone is trying to push the door open and the user needs assistance closing the door and shutting out an intruder.

Figure 2:
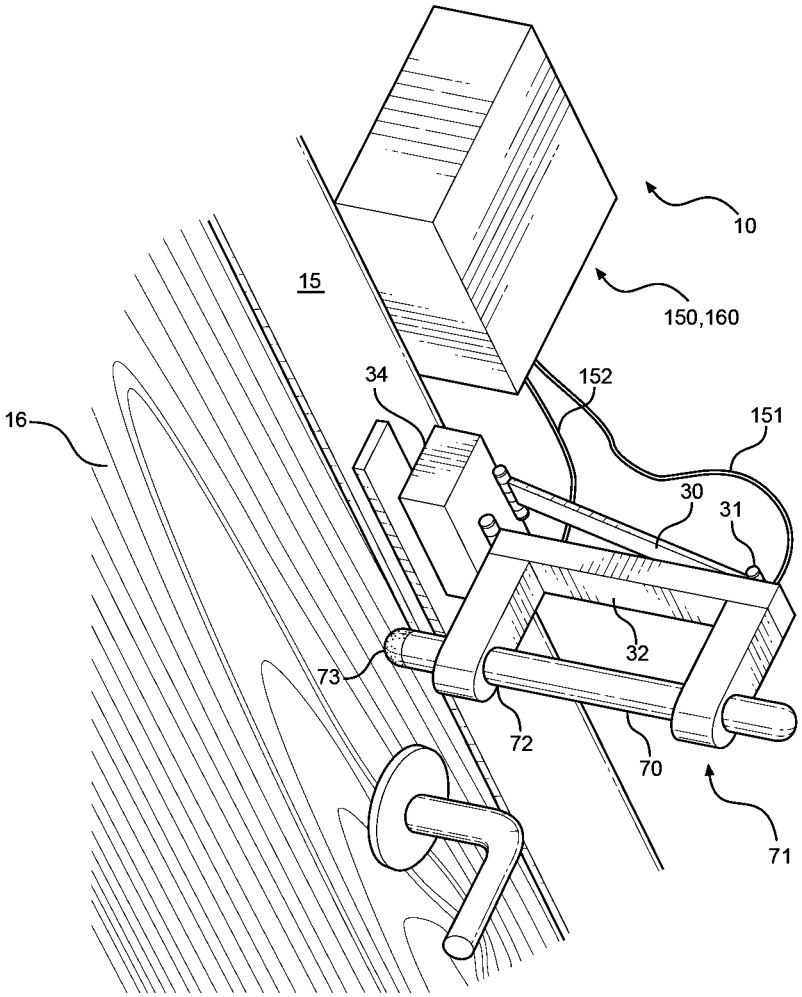
FIG. 2 shows a view of an embodiment of the invention in a working state.
Figure 3:
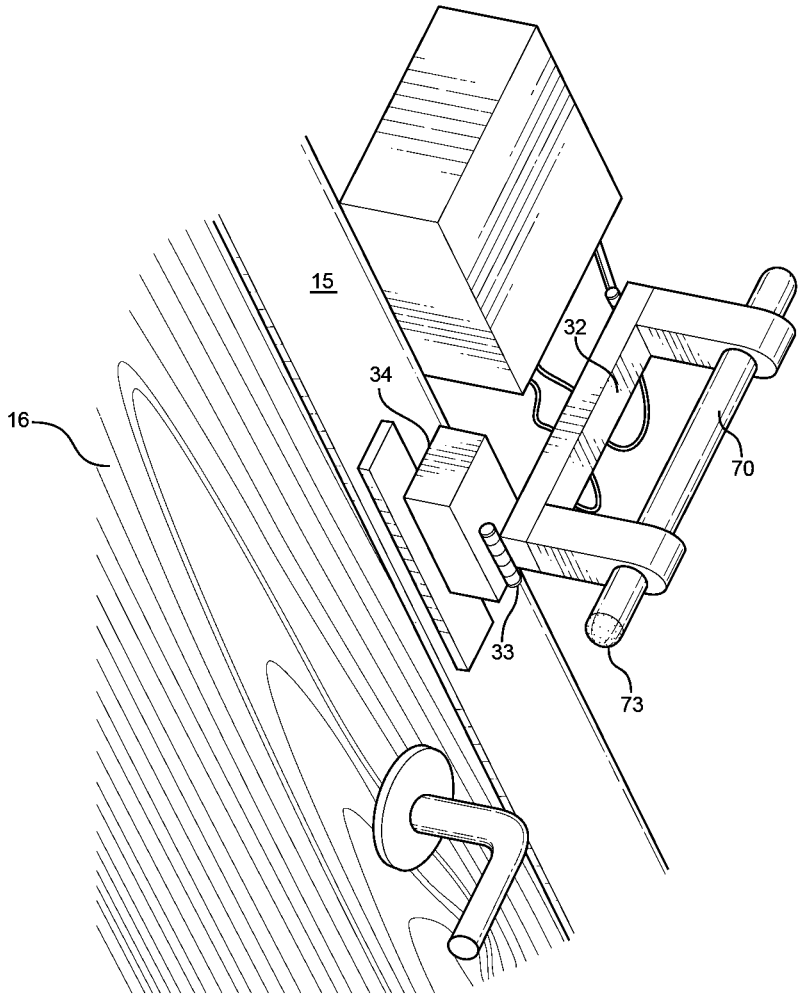
FIG. 3 shows a view of an embodiment of the invention in a stowed state.

Referring now to FIGS. 2 and 3, there are shown views of an embodiment of the present invention in which the movable arm 73 is operated by way of a hydraulic or pneumatic cylinder 70. A hydraulic pump assembly 150 or pneumatic pump assembly 160, respectively, are supported within the housing unit 10 adjacent to the door to operate the movable arm 73. In this embodiment, the electric motor within the housing unit, operates a pump, which drives hydraulic fluid or compressed air into one of two lines 151, 152. The lines support the fluid or air, and are used to forcibly move the movable arm 73 within the cylinder 70. When extending the movable arm 73, the pump sends fluid or compressed air into the extend line 151, forcing the movable arm 73 from the interior of the cylinder 70. When retracting the movable arm 73, the pump sends fluid or compressed air into the retract line 152, which forces the movable arm 73 into the cylinder 70 interior. The extent of the movable arm 73 expose from the cylinder 70 is determined by the extend limit switch and the retract limit switch, which provide input to the processor to cease operation of the electric motor, and thus the pump, when the movable arm 73 has been moved to the desired position (i.e. the extended or retracted position).

Within the housing unit 10 is preferably a valve that is operably controlled by the processor. The valve diverts hydraulic fluid or compressed air into one of the extend line 151 or the retract line 152, depending on the desired direction for the movable arm 73. When the valve is diverting fluid or compressed air to extend the movable arm 73, the pump drives hydraulic fluid or compressed air to a first end 71 of the cylinder 70 via the extend line 151. When the valve is diverting fluid or compressed air to retract the movable arm 73, the pump drives hydraulic fluid or compressed air to a second end 72 of the cylinder 70 via the retract line 152.

The cylinder 70 and the movable arm 73 are supported along the door frame 15 by a mounting member 34 and a hinge 33. The hinge 33 operatively allows the cylinder 70 and movable arm 73 to be pivoted into a working position or the stowed position. FIG. 2 represents a working position, whereby the movable arm 73 is in the swing path of the door. FIG. 3 represents a stowed position, whereby the movable arm 73 is outside of the swing path of the door. When in a working position, the movable arm 73 can move between the extended position and the retracted position to allow a partially ajar door, or a closed door.

The hydraulic or pneumatic cylinder 70 is preferably supported by a frame 32. The frame 32 is connected to the hinge 33, which is connected to the mounting member 34 affixed to the door frame 15. The lines 151, 152 extend from the housing unit 10 and to the frame 32 when the frame is in either the working or stowed position. The housing unit 10 is also preferably mounted to the wall adjacent to the door 16. To secure the cylinder 70 and the frame 32 in a working state, the hinge 33 further comprises a locking member to prevent pivoting of the cylinder and movable arm about the hinge 33 while in a working state. The hinge locking member may take on several forms, whereby the hinge 33 is prevented from free rotation. In one embodiment, the locking member further comprises a kickstand member 30 that extends between the frame 32 and the mounting member 34 to prevent rotation. The frame 32 may comprise a U-shaped member that supports the lines and the ends of the cylinder, while the hinge 33 affixes to one end thereof. The kickstand member 30 extends between the frame and the mounting member 34 to prevent rotation of the frame 32 against the mounting member 34 via the hinge 33. The kickstand member 30 extends from a point along the outer surface 31 of the frame 32, opposite of the cylinder 70.

Figure 4:
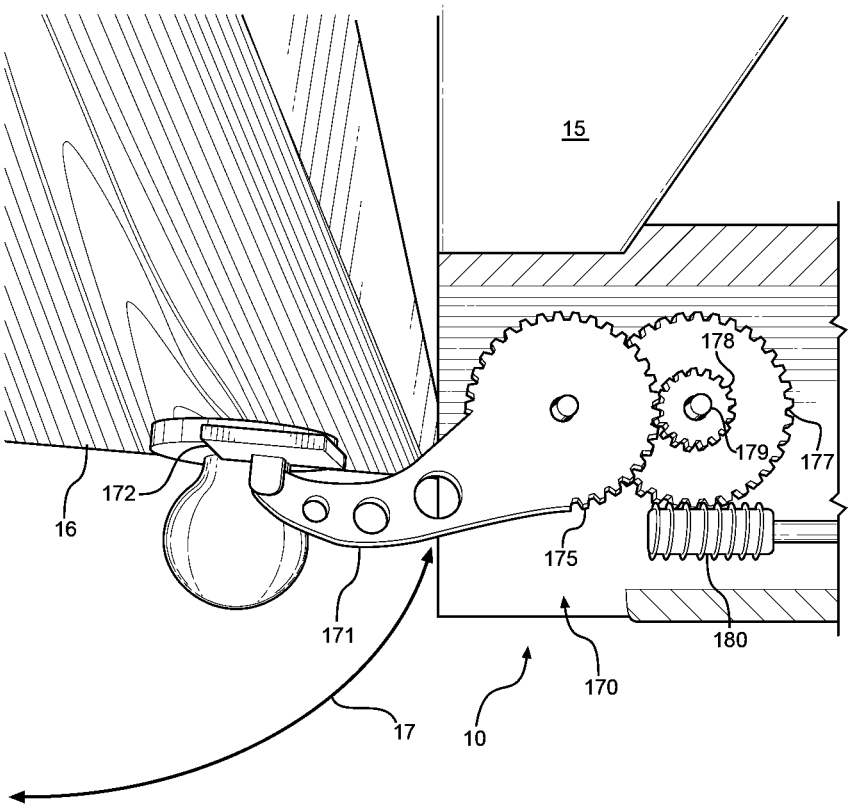
FIG. 4 shows an overhead view of an embodiment of the invention with the movable arm in the retracted position.
Figure 5:
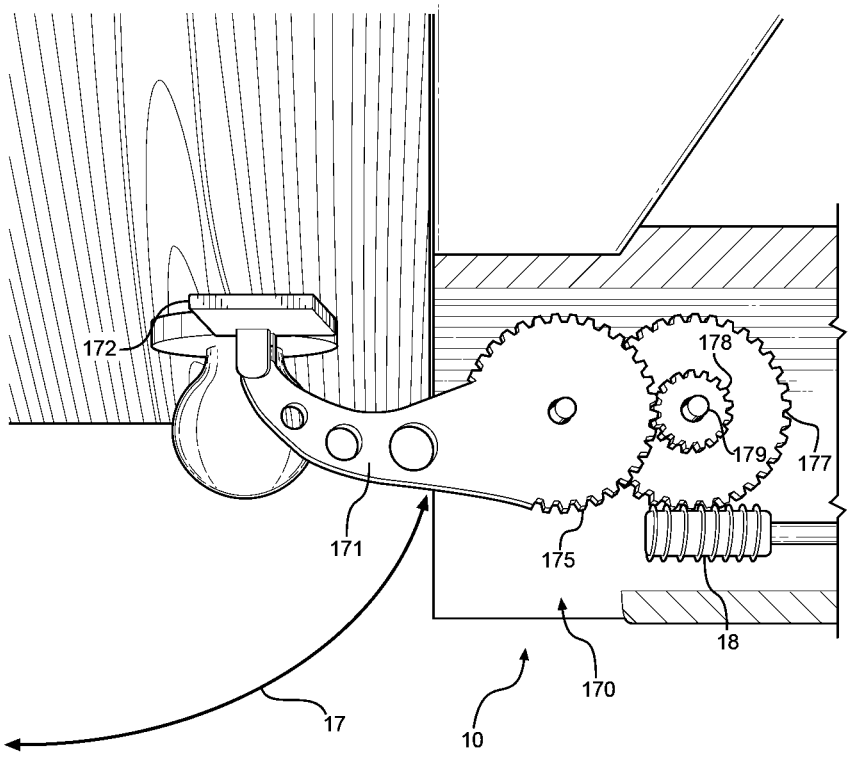
FIG. 5 shows an overhead view of the invention with the movable arm in the extended position.
Figure 6:
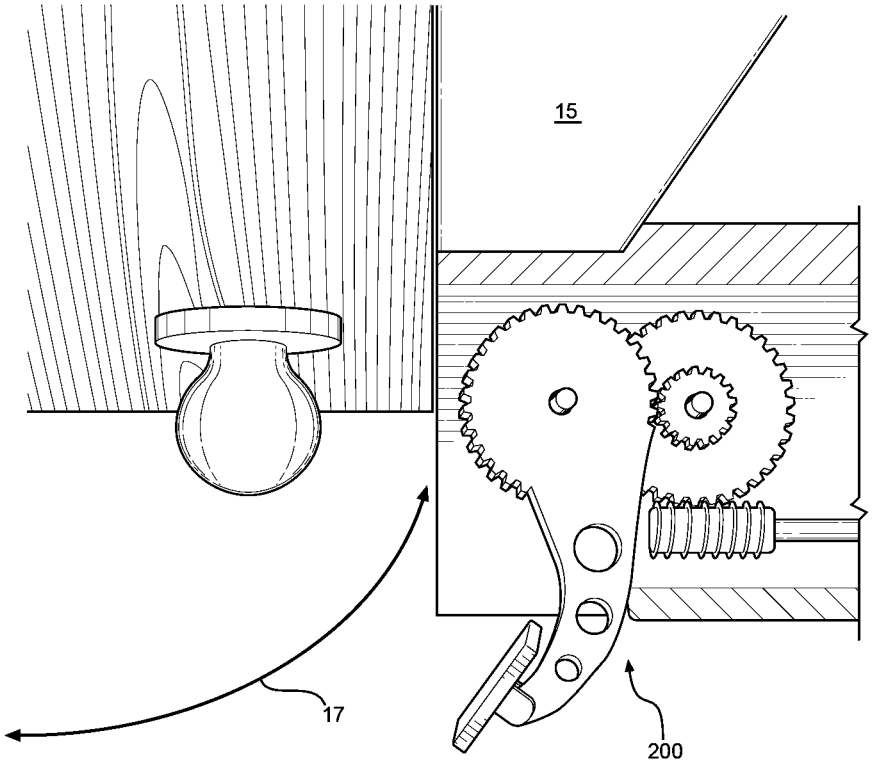
FIG. 6 shows an overhead view of the invention with the movable arm in the stowed position.

Referring now to FIGS. 4-6, there are shown views of another embodiment of the present invention. In this embodiment, the electric motor drives a gear assembly 170. The electric motor acts as the motive input for the gear assembly 170, which in turn drives the movable arm 171 between its retracted and extended positions. As shown in FIG. 4, the movable arm 171 is in its retracted position, whereby the door 16 can slightly open and the working end 172 of the movable arm 171 is within the swing path 17 of the door 16. As shown in FIG. 5, the movable arm 171 is in its extended position, whereby the door 16 is closed and the working end 172 of the movable arm 171 is pressed against the interior surface of the door 16. The extend limit switch and the retract limit switch are used to control the position of the movable arm 171 within the range of the extended and retracted position, respectively.

The gear assembly 170 is an assembly disposed between the electric motor and the movable arm 171. The gear assembly 170 comprises a worm gear 180 that is driven by the electric motor. The worm gear 180 includes gear teeth that drive an intermediate gear 177 disposed at a right angle relative to the worm gear 180. As the worm gear 180 rotates, the intermediate gear 177 is rotated about its gear shaft 179. Disposed on the same gear shaft 179 is a driver gear 178, which turns in unison with the intermediate gear 177 and drives a movable arm gear 175 disposed on the proximal end of the movable arm 171. Therefore, the worm gear 180 is meshed with the intermediate gear 177, and the drive gear 178 turns with the intermediate gear 177 and is meshed with a movable arm gear 175 connected to the movable arm 171. The number of gears and their relative size may vary, depending on the size of the housing unit, the gear ratios desired, and the size of the electric motor. In one embodiment, the drive gear 178 has a smaller diameter than the intermediate gear 177. As the worm gear 180 is rotated by the electric motor, the movable arm 171 is moved between the extended position and the retracted position, based on the spin direction of the electric motor. When the electric motor drives the worm gear in a first rotational direction, the moveable arm moves from the retracted position to the extended position. Likewise, when the electric motor drives the worm gear in a second rotational direction, the movable arm is moved into the retracted position from the extended position. As shown in FIG. 6, the movable arm may have an option to move completely out of the swing path 17 of the door and into a stowed position 200.

Figure 7:
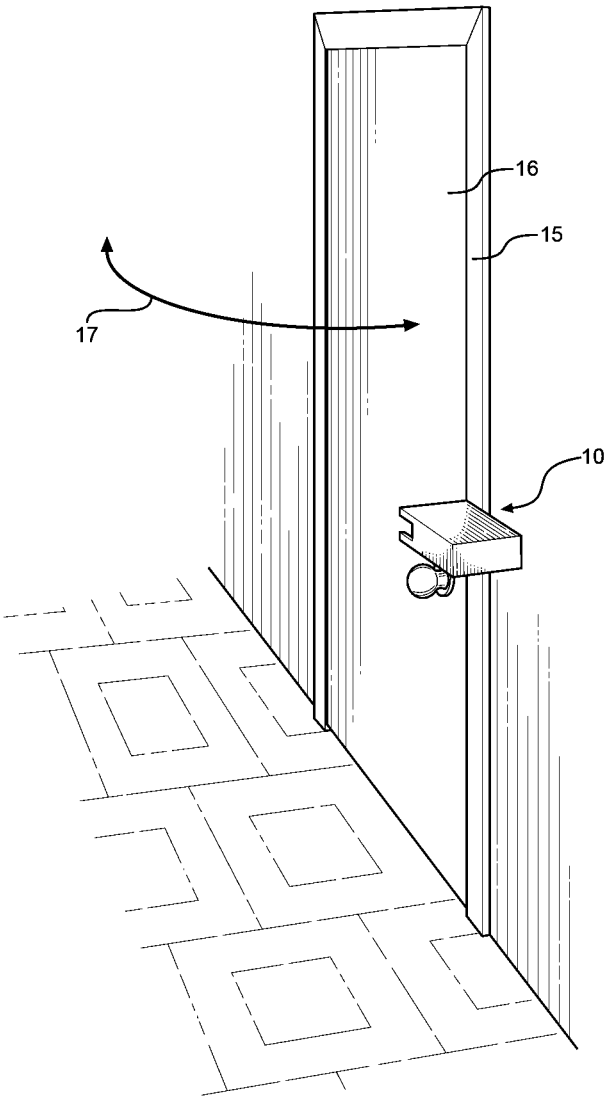
FIG. 7 shows the housing unit of the present invention affixed to the door frame of a doorway.

Finally, referring to FIG. 7, there is shown a view of the housing unit 10 secured to the door frame 15 of a door 16. The movable arm is disposed within the swing path 17 of the door 16, and the system allows a user to partially open a door when the movable arm is in the retracted position. When force is measured on the movable arm after the arm has been placed in the retracted position, the controller assembly will engage the electric motor to drive the movable arm into the extended position, thereby closing the door. The movable arm can also be moved into a stowed position to allow free swinging of the door, without interference by the movable arm. This may be accomplished through a hinge, or via a stowed position of the movable arm.

Other embodiments contemplated are listed below. In one embodiment, the housing unit is covered by a steel plate floor cover that pops up out of the floor at approximately a 45 to 60% angle. The force-generating system may by hydraulics, pneumatics, electrical, mechanical, or any other such system that is adapted to quickly generate force and extend the arms. The present invention further comprises an activation means, which may be either a button or foot pedal that can be actuated by the user or a pressure sensor. The activation means engages the force-generating system, thereby causing the pop-up plate to quickly accelerate forwardly towards the ajar door and slam the ajar door closed. For embodiments of the present invention wherein the activation means is a pressure sensor, the device is adapted to automatically detect attempted forced entries through the door and respond by activating system, slamming the door on the attempted intruder. The present invention is adapted to automatically detect an attempted forced entry and assist the user in resisting said forced entry. For embodiments of the present invention wherein the activation means is a button, the button is preferably positioned so that it can be quickly and easily reached by a user during an emergency forced entry situation, whether that be along the wall or as a foot pedal along the floor. The present invention is adapted to provide assistive force to users attempting to resist a forced entry and is generally not adapted to slam a door shut on its own. A standalone unit that can be classified as a door answering service itself, activation means is by remote control or otherwise.

In another embodiment of the present invention, the system includes a track is installed within a building adjacent to a doorway, a planar member that is adapted to transition between a deployed state and a position in which it lies flush against the floor, a force-generating system installed beneath the building's floor, and an activation means. As with the previously described embodiment of the present invention, the force-generating system comprises hydraulics, pneumatics, mechanical, electrical, and all other such systems adapted to generate quickly generate force when engaged and the activation means comprises a button, a pressure sensor, or any other such system adapted to transmit an activation signal to the force-generating system. In this embodiment of the present invention, the planar member is adapted to slide along the track. When the system is activated, the force-generating system accelerates the planar member along the track, thereby causing the planar member to make contact with the ajar door and slam the door shut. As with the first embodiment of the present invention, the second embodiment is adapted to prevent forced entries through a slightly open or otherwise ajar door by exerting more force, with the assistance of the user, on the interior surface of the door than the attempted intruder is able to exert on the exterior surface of the door.

In some of these alternate embodiments, the activation means comprises a foot pedal that is disposed at a location along the surface of the floor so that it can be easily accessed by a user during an emergency forced entry situation. The foot pedal comprises a means for relaying the actuation from the user to the force-generating system, thereby activating the system and causing the angled planar member to engage with the interior face of the door, thereby transferring the generated force to the door to assist in slamming the door on an intruder.

The present invention is adapted to provide a robust, secure door-closing system that can be selectively activated by users in order to slam doors, preventing forced entry into the building and thereby protecting individuals from unlawful intruders. Alternative embodiments of the present invention further comprise a pressure sensing means that is adapted to automatically activate the system and forcibly slam the door shut when a predetermined level of force is applied to the door. In this embodiment, individuals are automatically protected by the present system from forced entries and there is no need for the user to physically activate the system. Furthermore, the present invention may further comprise an alarm system that is triggered when the activation means is engaged. The alarm system comprises any audible or visual alert system that is known in the prior art. When the present invention is engaged, i.e. in place applying force to a door, it can be then be disengaged by the user to allow third parties entry through the door.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A door security and closing device, comprising:

a housing unit supporting a controller assembly and a movable arm;

a power supply;

the housing unit adapted to be secured to a door frame of a door;

the movable arm having an extended position disposed within a swing path of the door and against an interior surface of the door when the door is closed;

the movable arm having a retracted position within the swing path of the door and offset from the interior surface of the door when the door is closed;

the movable arm having a stowed position whereby the movable arm is outside of the swing path of the door;

the housing unit supporting an electric motor and the controller assembly;

the controller assembly further comprising a processor, a motor driver, a force transducer, a retract switch, an extend switch, an extend limit switch, and a retract limit switch;

the force transducer measuring the force applied to the movable arm when pressed upon by the door;

the retract limit switch closing when the movable arm is in the retracted position;

the extend limit switch closing when the movable arm is in the extended position;

wherein the retract limit switch serves a first function of deactivating the electric motor and a second function of activating a force measuring function of the force transducer;

wherein the processor and the motor driver direct the electric motor to move the movable arm into the extended position until the extend limit switch is closed when the extend switch is activated;

wherein the processor and the motor driver direct the electric motor to move the movable arm into the retracted position until the retract limit switch is closed when the retract switch is activated;

wherein if the force transducer measures a predefined force on the movable arm when in the retracted position, the processor and the motor driver direct the electric motor to move the movable arm into the extended position until the extend limit switch is closed.

2. The door security and closing device of claim 1, further comprising:

a hydraulic cylinder between the electric motor and the movable arm;

the electric motor driving a fluid pump that drives hydraulic fluid to a first end or a second end of the hydraulic cylinder to move the movable arm from a working end of the hydraulic cylinder;

a valve for operatively diverting the hydraulic fluid to the first end or second end of the hydraulic cylinder;

wherein the movable arm is moved into the extended position when the electric motor drives the fluid pump and the valve is diverting hydraulic fluid into the second end of the hydraulic cylinder;

wherein the movable arm is moved into the retracted position when the electric motor drives the fluid pump and the valve is diverting hydraulic fluid into the first end of the hydraulic cylinder.

3. The door security and closing device of claim 2, wherein:

the hydraulic cylinder and the movable arm are supported along the door frame by a mounting member and a hinge;

the hinge operatively allowing the hydraulic cylinder and the movable arm to be pivoted into a working position and the stowed position;

whereby in the working position, the movable arm can move between the extended position and the retracted position.

4. The door security and closing device of claim 3, wherein:

the hinge further comprises a locking member to prevent pivoting of the hydraulic cylinder and the movable arm about the hinge.

5. The door security and closing device of claim 4, wherein the locking member further comprises a kickstand member.

6. The door security and closing device of claim 1, a gear assembly between the electric motor and the movable arm;

the gear assembly comprising a worm gear driven by the electric motor;

the worm gear being meshed with an intermediate gear on a gear shaft;

a drive gear disposed on the gear shaft and rotating in unison with the intermediate gear;

the drive gear having a smaller diameter than the intermediate gear;

the drive gear being meshed with a movable arm gear connected to the movable arm;

wherein the movable arm is moved into the extended position when the electric motor drives the worm gear in a first rotational direction;

wherein the movable arm is moved into the retracted position when the electric motor drives the worm gear in a second rotational direction.

7. The door security and closing device of claim 6, wherein:

the gear assembly, the electric motor, and the movable arm are supported along the door frame by a mounting member.

8. The door security and closing device of claim 6, wherein:

the movable arm comprises a monolith member having a first end and a second end;

the first end being affixed to a planar stopper configured to evenly distribute a contact force with the door being secured over a surface area of the door;

the second end being comprising a circular shape having gear teeth disposed therearound a perimeter, wherein the gear teeth are configured to interlock with the drive gear upon rotation thereof.

9. The door security and closing device of claim 1, further comprising:

a pneumatic cylinder between the electric motor and the movable arm;

the electric motor driving a fluid pump that drives compressed air to a first end or a second end of the pneumatic cylinder to move the movable arm from a working end of the pneumatic cylinder;

a valve for operatively diverting the compressed air to the first end or second end of the pneumatic cylinder;

wherein the movable arm is moved into the extended position when the electric motor drives the fluid pump and the valve is diverting compressed air into the second end of the pneumatic cylinder;

wherein the movable arm is moved into the retracted position when the electric motor drives the fluid pump and the valve is diverting compressed air into the first end of the pneumatic cylinder.

10. The door security and closing device of claim 9, wherein:

the pneumatic cylinder and the movable arm are supported along the door frame by a mounting member and a hinge;

the hinge operatively allowing the pneumatic cylinder and the movable arm to be pivoted into a working position and the stowed position;

whereby in the working position, the movable arm can move between the extended position and the retracted position.

11. The door security and closing device of claim 10, wherein:

the hinge further comprises a locking member to prevent pivoting of the pneumatic cylinder and the movable arm about the hinge.

12. The door security and closing device of claim 11, wherein the locking member further comprises a kickstand member.

* * * * *